US011307536B2

(12) United States Patent
Chan et al.

(10) Patent No.: US 11,307,536 B2
(45) Date of Patent: Apr. 19, 2022

(54) WATCHES

(71) Applicant: RAZER (ASIA-PACIFIC) PTE. LTD., Singapore (SG)

(72) Inventors: Chee Oei Chan, Singapore (SG); Jian Yao Lien, Singapore (SG)

(73) Assignee: RAZER (ASIA-PACIFIC) PTE. LTD., Singapore (SG)

( * ) Notice: Subject to any disclaimer, the term of this patent is extended or adjusted under 35 U.S.C. 154(b) by 247 days.

(21) Appl. No.: 15/775,724

(22) PCT Filed: Nov. 12, 2015

(86) PCT No.: PCT/SG2015/050447
§ 371 (c)(1),
(2) Date: May 11, 2018

(87) PCT Pub. No.: WO2017/082814
PCT Pub. Date: May 18, 2017

(65) Prior Publication Data
US 2018/0253065 A1 Sep. 6, 2018

(51) Int. Cl.
*G04G 19/00* (2006.01)
*G04C 10/00* (2006.01)
(Continued)

(52) U.S. Cl.
CPC ..... *G04G 19/00* (2013.01); *G04C 10/00* (2013.01); *G04G 7/00* (2013.01); *G04G 9/007* (2013.01); *G04G 19/06* (2013.01); *G04G 19/12* (2013.01)

(58) Field of Classification Search
CPC ..... G04G 19/00; G04G 9/007; G04G 19/06; G04G 7/00; G04G 19/12; G04C 10/00
See application file for complete search history.

(56) References Cited

U.S. PATENT DOCUMENTS 3,885,381 A 5/1975 Kasai
3,916,613 A 11/1975 Esselborn
(Continued)

FOREIGN PATENT DOCUMENTS

CN 1246933 A 3/2000
CN 1433588 A 7/2003
(Continued)

OTHER PUBLICATIONS

Pull Up Resistor—https://www.electronics-tutorials.ws/logic/pull-up-resistor.html—Apr. 24, 2021.*
(Continued)

*Primary Examiner* — Sean Kayes
(74) *Attorney, Agent, or Firm* — Polsinelli PC

(57) ABSTRACT

According to various embodiments, a watch may be provided. The watch may include: a timing circuit configured to provide information about a current time; a smart watch circuit configured to provide smart watch functionality; a first battery configured to provide energy to the timing circuit; a second battery configured to provide energy to the smart watch circuit; and a communication circuit configured to provide communication between the timing circuit and the smart watch circuit; wherein the communication circuit includes a safety circuit configured to prevent leakage of current from the first battery to the second battery.

18 Claims, 9 Drawing Sheets

Over voltage tolerant fail-safe type I/O cell

(51) Int. Cl.

| | |
|---|---|
| ***G04G 19/12*** | (2006.01) |
| ***G04G 7/00*** | (2006.01) |
| ***G04G 9/00*** | (2006.01) |
| ***G04G 19/06*** | (2006.01) |

(56) References Cited

U.S. PATENT DOCUMENTS

| | | | | |
|---|---|---|---|---|
| 3,968,641 | A | 7/1976 | Moyer | |
| 4,672,642 | A * | 6/1987 | Willis | H03K 17/723 377/20 |
| 4,882,717 | A | 11/1989 | Hayakawa et al. | |
| 5,872,744 | A | 2/1999 | Taylor | |
| 6,288,979 | B1 * | 9/2001 | Kwok | G04G 19/12 368/205 |
| 6,301,198 | B1 | 10/2001 | Otaka et al. | |
| 6,342,802 | B1 | 1/2002 | Forehand et al. | |
| 6,744,698 | B2 | 6/2004 | Koyama et al. | |
| 7,028,547 | B2 | 4/2006 | Shiratori | |
| 8,310,201 | B1 | 11/2012 | Wright | |
| 8,562,489 | B2 | 10/2013 | Burton et al. | |
| 8,963,730 | B1 * | 2/2015 | Dickerman | G08B 21/185 340/636.1 |
| 9,011,292 | B2 | 4/2015 | Weast et al. | |
| 2013/0063219 | A1 * | 3/2013 | Shanan | H03B 5/1228 331/117 FE |
| 2014/0128691 | A1 | 5/2014 | Olivier | |
| 2014/0273821 | A1 | 9/2014 | Miller et al. | |
| 2015/0065893 | A1 | 3/2015 | Ye | |
| 2015/0085623 | A1 * | 3/2015 | Modaragamage | A44C 5/22 368/10 |
| 2015/0103633 | A1 * | 4/2015 | Henderson | G06F 1/3206 368/10 |
| 2015/0137791 | A1 * | 5/2015 | Remple | H02J 7/00 324/76.11 |
| 2015/0188112 | A1 | 7/2015 | Adre et al. | |
| 2015/0241914 | A1 | 8/2015 | Farjami | |
| 2015/0261189 | A1 * | 9/2015 | Connolly | G04G 21/025 368/277 |
| 2016/0109852 | A1 * | 4/2016 | Kuwabara | G04B 19/00 368/223 |

FOREIGN PATENT DOCUMENTS

| | | | |
|---|---|---|---|
| CN | 202003161 | U | 10/2011 |
| CN | 203858462 | U | 10/2014 |
| CN | 204440022 | U | 7/2015 |
| EP | 0961183 | B1 | 6/2005 |
| EP | 2219084 | A2 | 8/2010 |
| GB | 2374490 | A | 10/2002 |
| JP | 2012018098 | A | 1/2012 |
| KR | 10-1502766 | B1 | 3/2015 |
| WO | WO 2010/104952 | A1 | 9/2010 |
| WO | WO 2015/001434 | A1 | 1/2015 |

OTHER PUBLICATIONS

Office Action (including English Translation) dated Dec. 17, 2019, for the corresponding Taiwanese Application No. 105127136 in 16 total pages.

Extended European Search Report dated Oct. 24, 2018, 11 pages, for the corresponding European Patent Application No. 15908403.7.

International Preliminary Report on Patentability, dated Feb. 8, 2018, for the corresponding International Application No. PCT/SG2015/050447 in 5 pages.

International Search Report and Written Opinion, dated Jul. 29, 2016, for the corresponding International Application No. PCT/SG2015/050447 in 8 pages.

González, J.L., Rubio, A., & Moll, F., *Human Powered Piezoelectric Batteries to Supply Power to Wearable Electronic Devices*, vol. 10 (2002), No. 1, pp. 34-40.

Office Action (including English Translation) dated Dec. 16, 2019, for the corresponding Chinese Application No. 201580085719.2 in 17 total pages.

* cited by examiner

Over voltage tolerant fail-safe type I/O cell

600

| 602 Symbol | 604 Name | 606 Description |
|---|---|---|
| 04-20 | Date | Shows the current day (MM-DD or DD-MM) |
| | Chime | Indicates that the hourly chime is currently turned on |
| | Alarm | Indicates that the alarm is currently turned on |
| | Bluetooth | Shows that the Nabu Watch's Bluetooth is currently turned on |
| 23:45 | Time | Shows the current time (hour:minute:second) |

FIG 7

700

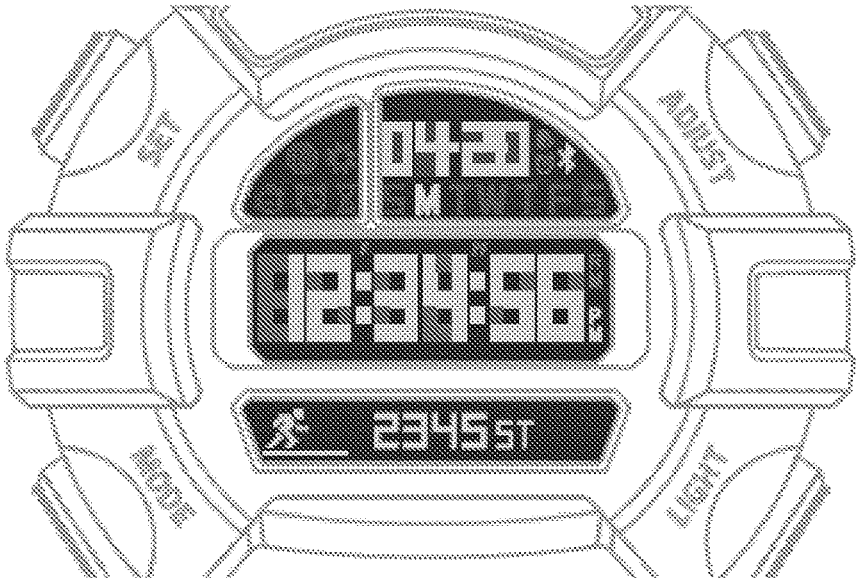

FIG 8

800

802 804 806

| Symbol | Name | Description |
|---|---|---|
| | Second Time Zone | Shows your custom time |
| | Settings | Use this mode to set the Key tone and the Bluetooth on or off |
| | Stopwatch | When this mode is selected, the Nabu Watch functions as a stopwatch |
| | Alarm | Use this mode if you want the Nabu Watch to alert you at a specific time |
| | Timer | When this mode is selected, the Nabu Watch functions as a countdown timer |

WATCHES

TECHNICAL FIELD

Various embodiments generally relate to watches.

BACKGROUND

Wearable device manufacturers are providing solutions with operating battery life of 3-14 days before the need to recharge. Some traditional watch companies that have gone into smartwatches have attempted to provide non-chargeable batteries in order to have a lasting watch functions but this assumes an electronic notification of (only) one notification a day, which is impractical. Thus, there may be a need for enhanced management of battery life in wearable devices.

SUMMARY OF THE INVENTION

According to various embodiments, a watch may be provided. The watch may include: a timing circuit configured to provide information about a current time; a smart watch circuit configured to provide smart watch functionality; a first battery configured to provide energy to the timing circuit; a second battery configured to provide energy to the smart watch circuit; and a communication circuit configured to provide communication between the timing circuit and the smart watch circuit; wherein the communication circuit includes a safety circuit configured to prevent leakage of current from the first battery to the second battery.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. The dimensions of the various features or elements may be arbitrarily expanded or reduced for clarity. In the following description, various embodiments of the invention are described with reference to the following drawings, in which:

FIG. 7 shows an enlarged view of the watch face and buttons of a watch according to various embodiments;

FIG. 8 shows a table illustrating various symbols according to various embodiments;

DETAILED DESCRIPTION

Figure 1:
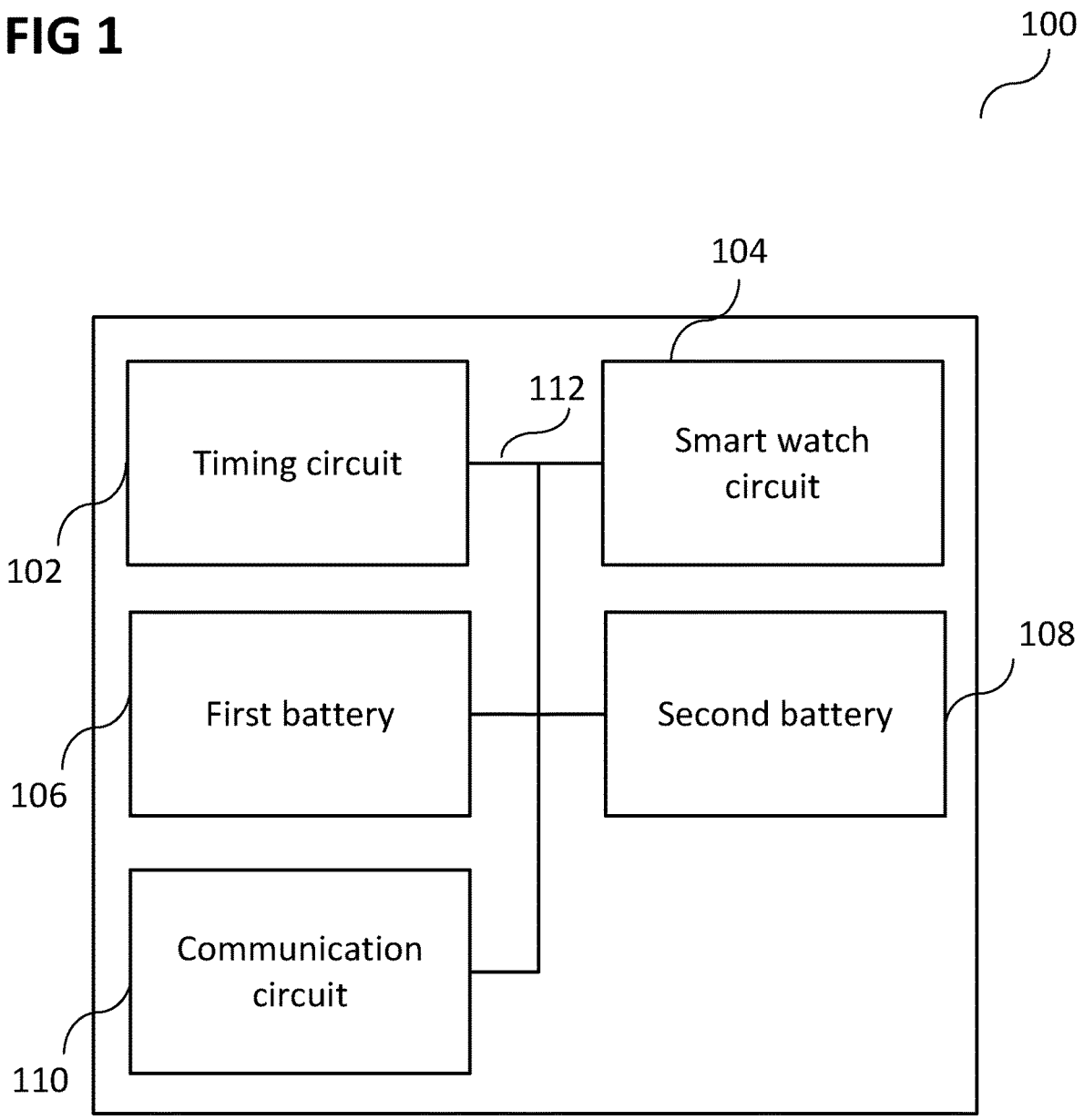
FIG. 1 shows a watch according to various embodiments.

The following detailed description refers to the accompanying drawings that show, by way of illustration, specific details and embodiments in which the invention may be practiced. These embodiments are described in sufficient detail to enable those skilled in the art to practice the invention. Other embodiments may be utilized and structural, and logical changes may be made without departing from the scope of the invention. The various embodiments are not necessarily mutually exclusive, as some embodiments can be combined with one or more other embodiments to form new embodiments.

In this context, the watch as described in this description may include a memory which is for example used in the processing carried out in the watch. A memory used in the embodiments may be a volatile memory, for example a DRAM (Dynamic Random Access Memory) or a non-volatile memory, for example a PROM (Programmable Read Only Memory), an EPROM (Erasable PROM), EEPROM (Electrically Erasable PROM), or a flash memory, e.g., a floating gate memory, a charge trapping memory, an MRAM (Magnetoresistive Random Access Memory) or a PCRAM (Phase Change Random Access Memory).

In an embodiment, a "circuit" may be understood as any kind of a logic implementing entity, which may be special purpose circuitry or a processor executing software stored in a memory, firmware, or any combination thereof. Thus, in an embodiment, a "circuit" may be a hard-wired logic circuit or a programmable logic circuit such as a programmable processor, e.g. a microprocessor (e.g. a Complex Instruction Set Computer (CISC) processor or a Reduced Instruction Set Computer (RISC) processor). A "circuit" may also be a processor executing software, e.g. any kind of computer program, e.g. a computer program using a virtual machine code such as e.g. Java. Any other kind of implementation of the respective functions which will be described in more detail below may also be understood as a "circuit" in accordance with an alternative embodiment.

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

The reference to any prior art in this specification is not, and should not be taken as an acknowledgement or any form of suggestion that the referenced prior art forms part of the common general knowledge in Australia (or any other country).

In order that the invention may be readily understood and put into practical effect, particular embodiments will now be described by way of examples and not limitations, and with reference to the figures.

Various embodiments are provided for devices, and various embodiments are provided for methods. It will be understood that basic properties of the devices also hold for the methods and vice versa. Therefore, for sake of brevity, duplicate description of such properties may be omitted.

It will be understood that any property described herein for a specific device may also hold for any device described herein. It will be understood that any property described herein for a specific method may also hold for any method described herein. Furthermore, it will be understood that for any device or method described herein, not necessarily all the components or steps described must be enclosed in the device or method, but only some (but not all) components or steps may be enclosed.

The term "coupled" (or "connected") herein may be understood as electrically coupled or as mechanically coupled, for example attached or fixed or attached, or just in contact without any fixation, and it will be understood that both direct coupling or indirect coupling (in other words: coupling without direct contact) may be provided.

Wearable device manufacturers are providing solutions (for example wearable devices, for example smartwatches) which do not have a long battery life, for example with operating battery life of 3-14 days, so that they require charging after 3-14 days of use. Some traditional watch companies that have gone into smartwatches have attempted to provide (in other words: employ) non-chargeable (in other words: traditional) batteries in smartwatches in order to have a lasting watch functions but this assumes an electronic notification of (only) one notification a day, which is impractical. It will be understood that the meaning of notification message is where a mobile phone send a summary message (such as: SMS (short message service), email, WhatsApp, incoming call etc.). An average user may typically receive between 50 and 200 notifications per day, especially with the prevalent use of WhatsApp, Facebook, and Twitter short messages.

In other words, with the propagation of wearable device targeting fitness and notification, suppliers are providing a series of solutions with operating battery life of 3-14 days before the devices need to be recharged. While watch companies attempt to provide devices using a non-chargeable battery to have long lasting watch function, they have the assumption of only one notification per day, which is impractical.

According to various embodiments, a solution may be provided for the management of battery life in wearable devices.

According to various embodiments, a dual battery watch with notification (in other words: a smart watch with (at least) two batteries) may be provided.

According to various embodiments, a dual battery concept (for example including a traditional battery and an electronic battery) may be provided.

FIG. 1 shows a watch 100 according to various embodiments. The watch 100 may include a timing circuit 102 configured to provide information about a current time. The watch 100 may further include a smart watch circuit 104 configured to provide smart watch functionality. The watch 100 may further include a first battery 106 configured to provide energy to the timing circuit 102. The watch 100 may further include a second battery 108 configured to provide energy to the smart watch circuit 104. The watch 100 may further include a communication circuit 110 configured to provide communication between the timing circuit 102 and the smart watch circuit 104. The communication circuit 110 may include a safety circuit configured to prevent leakage of current from the first battery 106 to the second battery 108. The timing circuit 102, the smart watch circuit 104, the first battery 106, the second battery 108, and the communication circuit 110 may be coupled with each other, like indicated by lines 112, for example electrically coupled, for example using a line or a cable, and/or mechanically coupled.

In other words, different batteries may be provided for different functionalities of the watch, and leakage of current between the different batteries may be prevented.

According to various embodiments, the first battery 106 may be configured to provide energy only to the timing circuit 102. It will be understood that the timing circuit 102 may provide traditional watch functions, which are not limited to time keeping only, but may include alarms, timer, or lapse, for example.

According to various embodiments, the second battery 108 may be configured to provide energy to the smart watch circuit 104 and to the timing circuit 102 if it is determined (for example by a further circuit of the watch 100), that the second battery 108 includes more than a pre-determined energy (for example, the second battery 108 includes enough energy to provide both the smart watch circuit 104 and the timing circuit 102 with energy).

According to various embodiments, the first battery 106 may be configured to prevent providing energy to the smart watch circuit 104.

According to various embodiments, the second battery 108 may be configured to provide energy only to the smart watch circuit 104.

According to various embodiments, the second battery 108 may be configured to prevent providing energy to the timing circuit 102.

According to various embodiments, the communication circuit 110 may include an input/output buffer.

According to various embodiments, the input/output buffer may include or may be the safety circuit.

According to various embodiments, the input/output buffer may include a plurality of first connections connected to the timing circuit, and may further include a plurality of second connections connected to the smart watch circuit.

According to various embodiments, the first connections may be configured to float.

According to various embodiments, the second connections may be configured to pull low for output connections among the second connections.

According to various embodiments, the second connections may be configured to use a pullup resistor for input connections among the second connections.

According to various embodiments, the communication circuit 110 may be configured to transmit setting information from the timing circuit 102 to the smart watch circuit 104 (and/or vice versa from the smart watch circuit 104 to the timing circuit 102). According to various embodiments, a user may make watch settings from a smart phone app. The smart phone app may push the watch settings to the smart watch circuit 104 wirelessly. From the smart watch circuit 104, the information may be synchronized to the timing circuit 102. The user may also manually set the timing function and this setting may be pushed to smart watch circuit 104 to relay the latest settings back to the smart phone app.

According to various embodiments, the setting information may include or may be the information about the current time.

According to various embodiments, the setting information may include or may be information indicating user preference settings.

According to various embodiments, the communication circuit 110 may be configured to provide synchronization information between the timing circuit 102 and the smart watch circuit 104.

According to various embodiments, the watch 100 may further include a display (not shown in FIG. 1). The timing circuit 102 may be configured to provide the information about the current time on the display. The smart watch circuit 104 may be configured to provide information based on the smart watch functionality on the display. The smart watch circuit 104 may for example provide function like wellness (such as step counts, calories, heart rate, UV (ultra violet; for example UV measurements), temperature, depth). The smart watch circuit 104 may further provide a 24 hrs link to a smart phone for notification messages etc.

According to various embodiments, the watch 100 may further include a first display and a second display (not shown in FIG. 1). The timing circuit 102 may be configured to provide the information about the current time on the first display. The smart watch circuit 104 may be configured to provide information based on the smart watch functionality on the second display.

According to various embodiments, the first battery 106 may include or may be a non-rechargeable battery.

According to various embodiments, the first battery may include or may be a coin cell.

According to various embodiments, the first battery 106 may be configured to provide a current of at least substantially 20 uA or less in average.

According to various embodiments, the second battery may include or may be a rechargeable battery.

According to various embodiments, the second battery may include or may be a lithium ion battery.

According to various embodiments, the second battery may be configured to provide an average current of more than 50 uA.

According to various embodiments, a system (for example an electronic smartwatch) may be provided which supports dual batteries like described in the following.

According to various embodiments, a first battery (which may for example be referred to as Battery 1) supports purely (in other words: only; in other words: no other functions than) watch functions, where an average current is for example 20 uA or less;

According to various embodiments, a second battery (which may for example be referred to as Battery 2) supports wireless, sensors and notifications function that always link to a smart phone with higher average current consumption, for example of 100-200 uA (the second battery may not support (or be used for) the watch functions, for which the first battery is provided).

According to various embodiments, a communication channel between the watch circuits and the wireless circuits may be provided for synchronisation (for example time synchronization or synchronizations of settings). The communication channel may be able to withstand the fluctuation of battery voltage level between the 2 systems (in other words: between the two batteries, i.e. between the first battery and the second battery).

According to various embodiments, both systems (in other words: between the two batteries, i.e. between the first battery and the second battery) share a common reference voltage e.g. ground to allow seamless communication between both systems (in other words: between both batteries).

According to various embodiments, the design may take into consideration current leakage and back bias issues between the two systems (in other words: between both batteries).

Figure 2A:
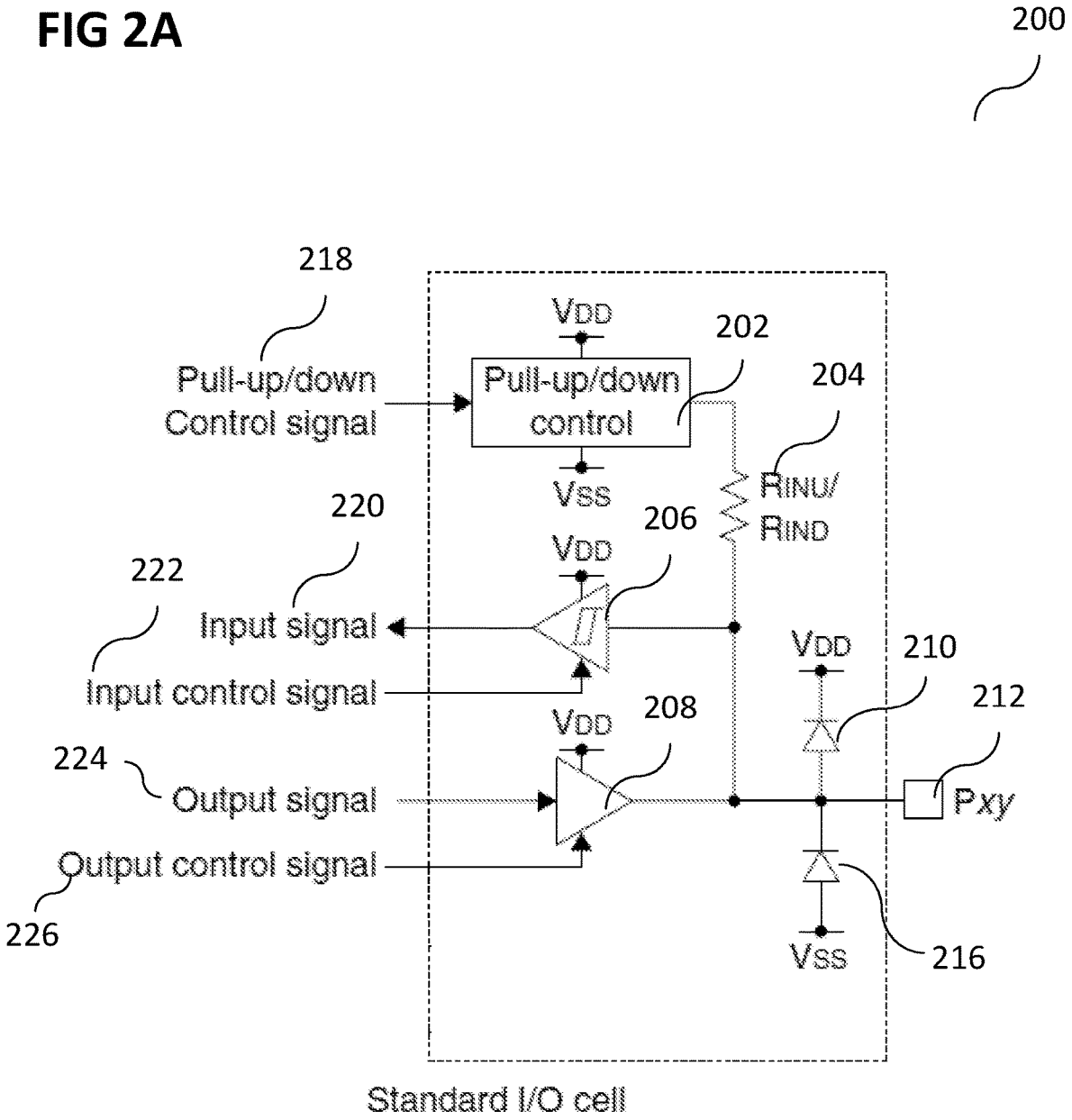
FIG. 2A shows a standard I/O (input/output) cell.

FIG. 2A shows a standard I/O (input/output) cell 200. A pull-up/down control signal 218 may be provided to a pull-up/down control circuit 202, which may be connected to $V_{DD}$ (which may be the power supply) and $V_{SS}$ (which may be the negative power supply). The pull-up/down control circuit 202 may (via a resistor $R_{INU/IND}$ 204) be connected to an amplifier 206 (which may be connected to $V_{DD}$), an amplifier 208 (which may be connected to $V_{DD}$), a $P_{xy}$ port 212, and to $V_{DD}$ via a diode 210, and to $V_{SS}$ via a diode 216. An input control signal 222 may be input to the amplifier 2086, and an input signal 220 may be output from the amplifier 206. An output signal 224 and an output control signal 226 may be input into the amplifier 208.

According to various embodiments, a special communication interface may be provided.

Figure 2B:
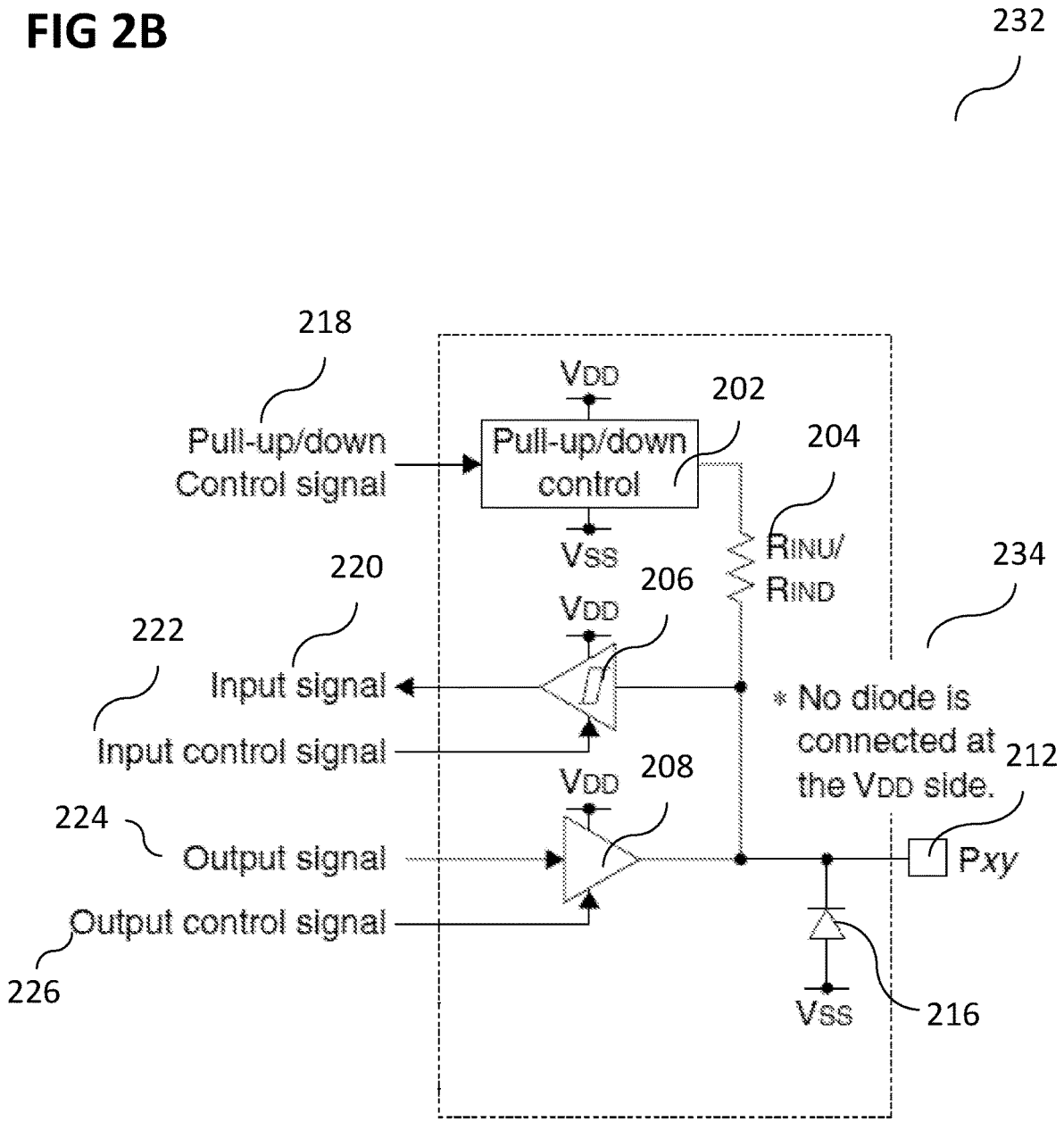
FIG. 2B shows an over voltage tolerant fail-safe type I/O cell according to various embodiments.

FIG. 2B shows an over voltage tolerant fail-safe type I/O cell 232 according to various embodiments. Various portions of the cell 232 shown in FIG. 2B may be similar or identical to portions of the cell 200 shown in FIG. 2A, so that the same reference signs may be used and duplicate description may be omitted. Like indicated by 234, no diode is connected at the $V_{DD}$ side corresponding to the diode 216 at the $V_{SS}$ side. In other words, diode 210 shown in the cell 200 of FIG. 2A may not be present in the cell 232 of FIG. 2B.

Special I/O buffers (for example of an over voltage tolerant fail-safe type) as shown in FIG. 2B may be used to make the interconnection between the low power MCU (micro controller unit) that uses a normal coin cell (versus the one buffers use in a rechargeable battery platform). According to various embodiments, all I/Os from low the power MCU may float (in other words: may be not connected to any other signal or line). This may refer to the timing circuit. The rechargeable side MCU may pull LOW for those connections (or pins) configured as output, and may use a pullup resistor for the input side. This may prevent any leakage from the low power supply (in other words: from the portion of the watch powered by the first battery) to the rechargeable platform (in other words: to the portion of the watch powered by the second battery).

By providing a special I/O buffer according to various embodiments without the protection diode 210, the smart circuit when drive to high voltage e.g. 3V may not cause current leakage to a lower potential timing circuit of which operate less than 2.7V.

A typical diode may start to conduct current when there is a voltage difference of 0.3V onwards.

Likewise in the event that the timing circuit battery runs out of power and drops below 2V, the smart circuit supply may not leak through this protection diode which drains off the power quickly.

According to various embodiments, the system (for example watch) may work in the event when either of the battery is shut down by not allowing unwanted leakage path to flow between the two systems (in other words: between the timing circuit and the smart watch circuit).

Figure 3:
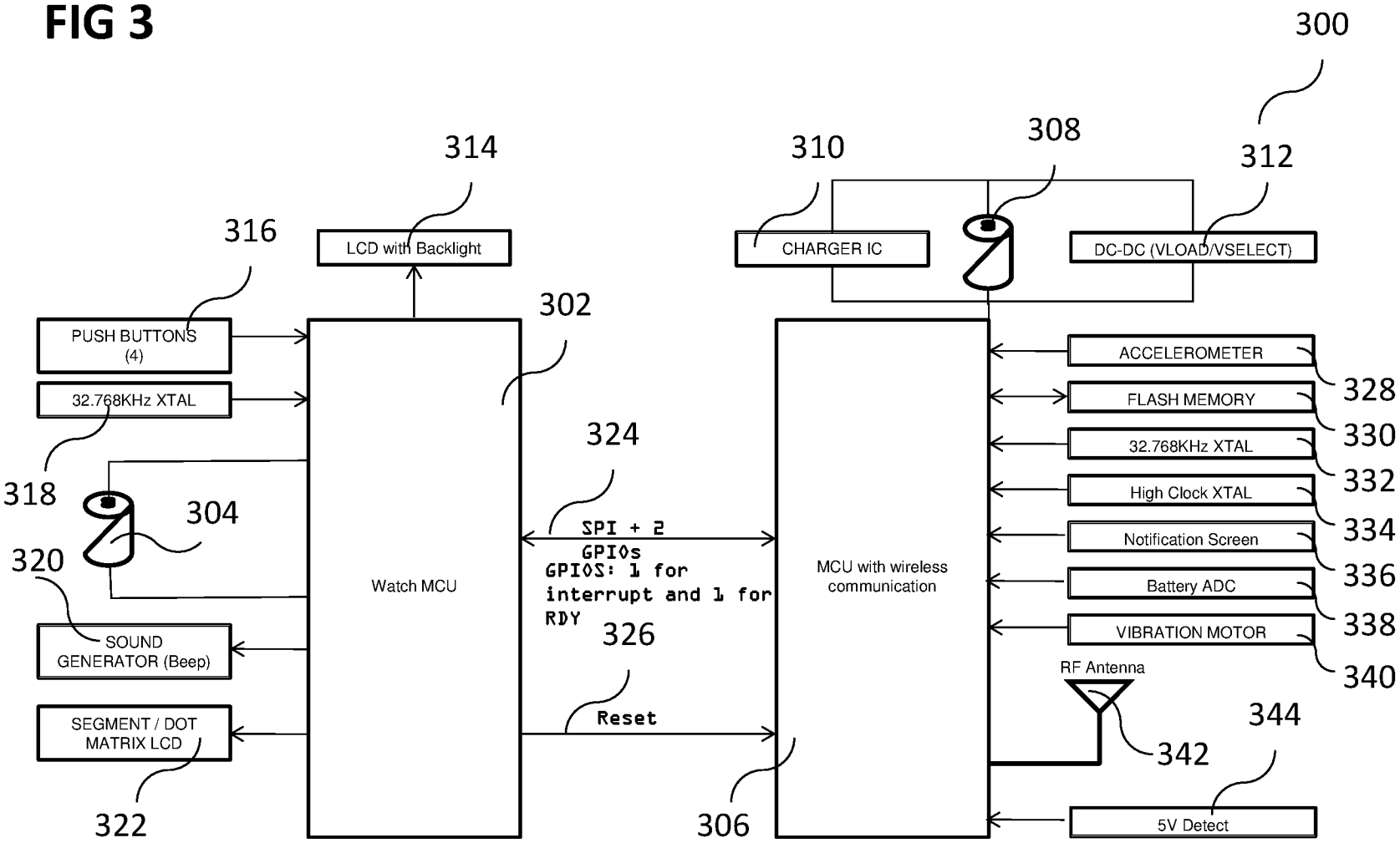
FIG. 3 shows an exemplary functional block diagram of a watch according to various embodiments.

FIG. 3 shows an exemplary functional block diagram 300 of a watch according to various embodiments. A watch MCU 302 (in other words: a timing circuit) may be powered by a first battery 304. An MCU 306 with wireless communication (in other words: a smart watch circuit) may be powered by a second battery 308. A charger IC (integrated circuit) 310 and a DC (direct current)-DC (VLoad/VSelect) circuit 312 may be connected to the second battery. An LCD (liquid crystal display) 314 with backlight, push buttons 316 (for example four push buttons), a 32.768 kHz XTAL (crystal) 318, a sound generator 320 (for example configured to provide a beep sound), and a segment (or dot) matrix LCD 322 may be connected to the watch MCU 302. An accelerometer 328, a flash memory 330, a 32.768 kHz XTAL 332, a high clock XTAL 334, a notification screen 336, a battery ADC (analog digital converter) 338, a vibration motor 340, an RF (radio frequency) antenna 342, and a 5V detection circuit 344 may be connected to the MCU 306 with wireless communication. A SPI (serial peripheral interface) and 2 GPIOs (general purpose input/output), wherein one GPIO may be used for interrupt, and one GPIO may be used for a RDY (ready) signal, may be used for communication between the watch MCU 302 and the MCU 306 with wireless communication, like indicated by 324. A reset signal 326 may be provided from the watch MCU 302 to the MCU 306 with wireless communication.

According to various embodiments, the watch MCU 302 may provide basic time keeping functions corresponding to traditional watch functions, refresh the LCD display 314, and handle input function of a watch (for example like "1. SET 2. ADJUST 3. MODE 4. BACKLIGHT"). The MCU 306 with wireless communication may handle functions like for example wellness such as step counts, calories, heart rate, UV, temperature, depth. It may also handle the wireless communication between the platform to a smart phone platform (or any smart host). It may also serve as message notifications from the smart phone. When a smart phone pushes a message wirelessly over to the watch, the MCU 306 may decipher the data, fetch the correct bitmap (for example characters, icons) from the pre-programmed flash content (in other words: content in the flash memory 330) and may push it over to smart display. The MCU 306 may vibrate the motor 340 according to the setting of user preferences in a mobile app. Sensor such as the accelerometer 328 may be used for step count, gesture based function (e.g. wrist turn, handshake). The 32 kHz XTAL 332 may provide the accurate RTC (real time clock) and timer for maintaining wireless link between watch and the smart phone. HIGH Clock XTAL 334 may only be used during the wireless communication data transfer and may go to sleep mode to conserve power. DC-DC 312 may be provided to have an efficient way of managing power where a LiON battery has average voltage 3.0V-4.2V while typical smart circuit operate at constant voltage ranging from 2.5V-3.3V.

Figure 9:
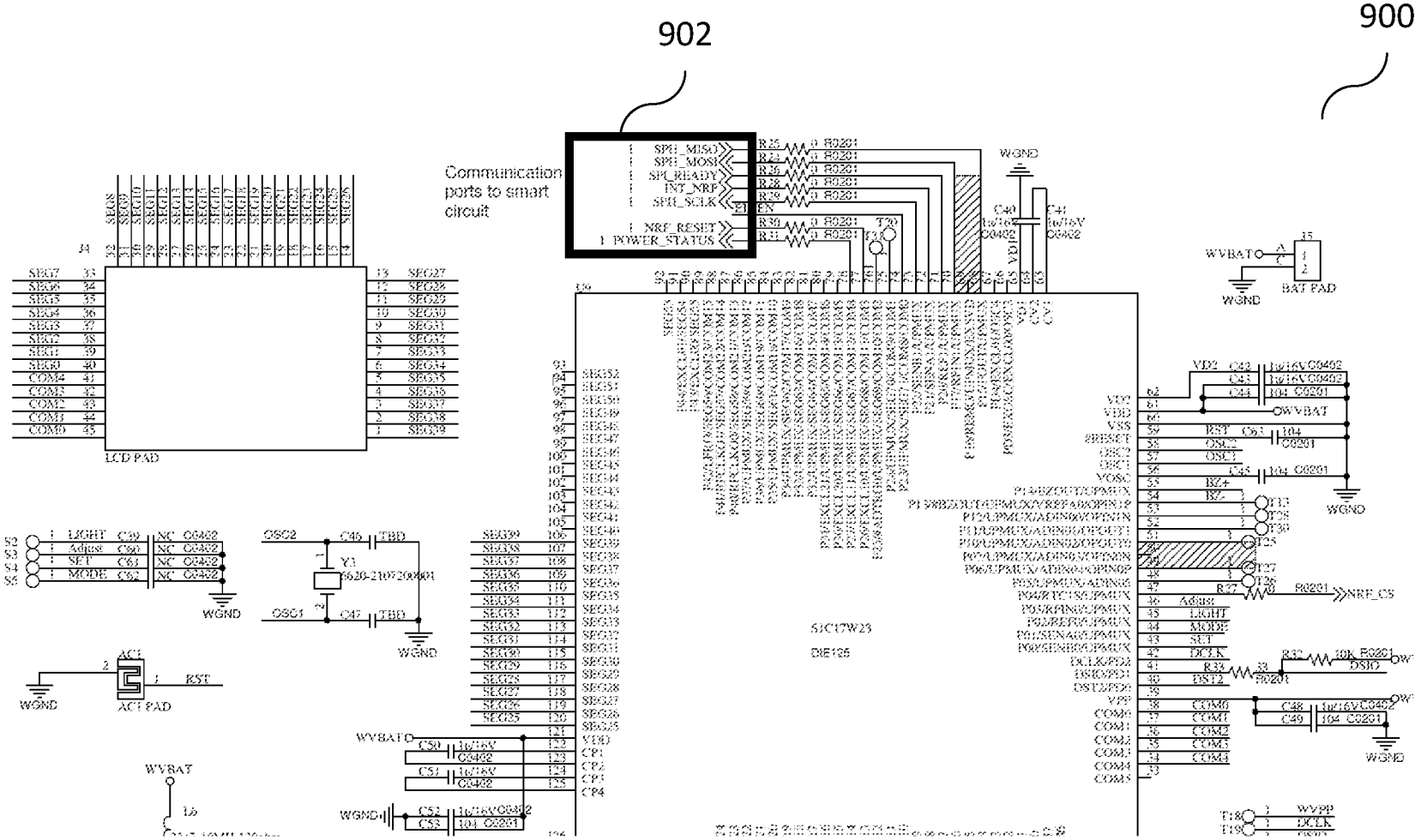
FIG. 9 and FIG. 10 show illustrations of a circuit showing an interconnect between two micro controller unit blocks according to various embodiments.
Figure 10:
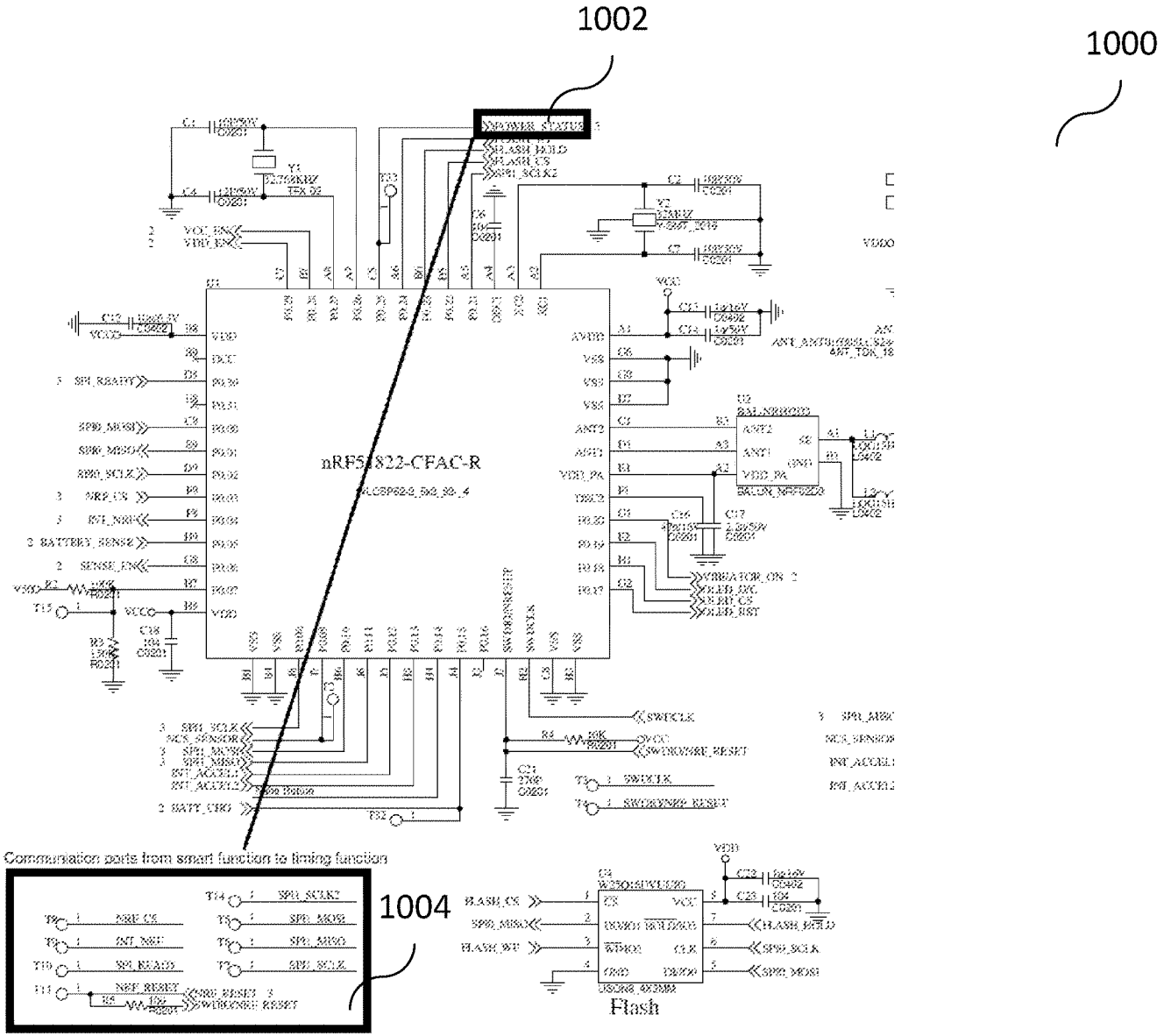

FIG. 9 shows an illustration 900 of a timing circuit according to various embodiments, and FIG. 10 shows and illustration 1000 of a smart watch circuit, and the interconnect between the two MCU blocks according to various embodiments is shown. The special I/O buffers are resided in the timing MCU block. Each line will have this I/O buffer. The key ports connection between the timing function MCU (in other words: timing circuit) shown in FIG. 9 and the smart function MCU (in other words: smart watch circuit) shown in FIG. 10 are illustrated in FIG. 9 and FIG. 10. Communication ports 902 may provide communication from the timing circuit to the smart watch circuit (in other words: smart circuit). Communication ports 1002 and 1004 may provide communication from the smart watch circuit to the timing circuit. These ports may provide (or may be) the key handshake between the smart and timing function when it comes to synchronizing of time, alarm or setting via the app in the smart phone. The communication ports 902, 1002, 1004 (for example SPI_MISO, SPI_MOSI, SPI_READY, SPI_SCLK, INT_NRF) may provide the above handshake function. The NRF_RESET port may provide a backdoor reset for the smart function via the buttons press from SET, ADJ, LIGHT. POWER_STATUS may serve as indicator to the timing function (in other words: to the timing circuit) when smart function (in other words: the smart watch circuit) is running of out of battery. This may allow the timing function to configure the communication to a state that minimizes leakage between the 2 MCU blocks.

According to various embodiments, a device (for example a watch) with a dual battery advantage may be provided.

According to various embodiments, a watch function may remain a primary function where a single battery may last over 12 months (in other words: the battery life may be more than 12 months).

According to various embodiments, a watch with integrated wireless, sensors and notification system with a battery life of 5-14 days that connect 7/24 with a smart phone may allow receiving over 100 notifications/day.

According to various embodiments, auto synchronization of a main watch clock may be provided whenever users go into a different time zone via smart phone.

According to various embodiments, the smart watch (for example via the MCU with the wireless communication) may connect to any kind of electronic device, for example to a smart phone, for example via Bluetooth, for example Bluetooth Low Energy (BT 4.0 or higher).

Figure 4:
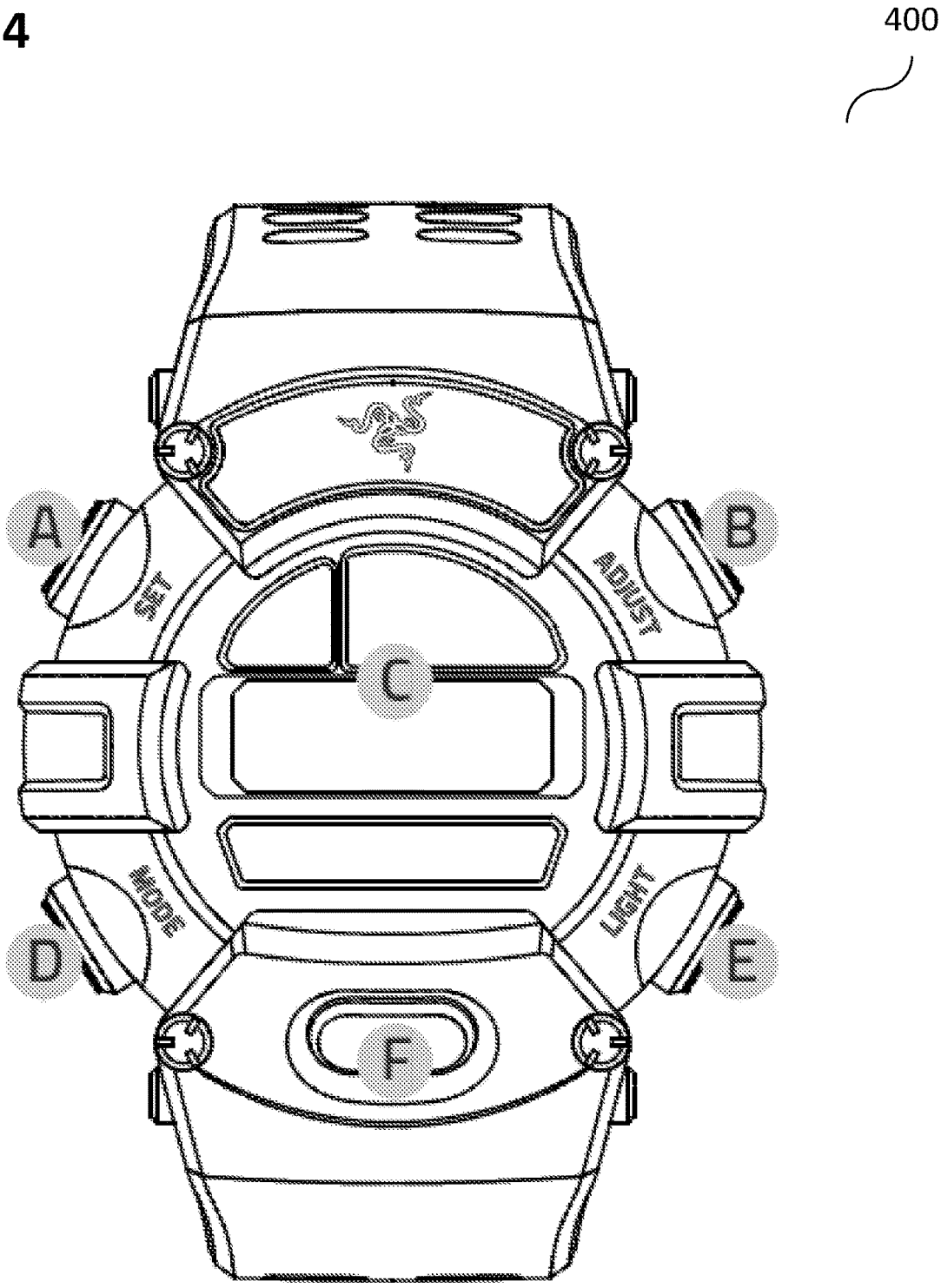
FIG. 4 shows a front view of a watch according to various embodiments.

FIG. 4 shows a front view of a watch 400 according to various embodiments. Various buttons may be provided (for example a set button (A), an adjust button (B), a mode button (D), a button to activate backlight (E), and a button for the smart watch functions of the watch (F). The watch face (C) may display the current time and/or other information. The watch may communicate with a smart phone to which an app (application) for communication has been downloaded.

Figures 5, 6:
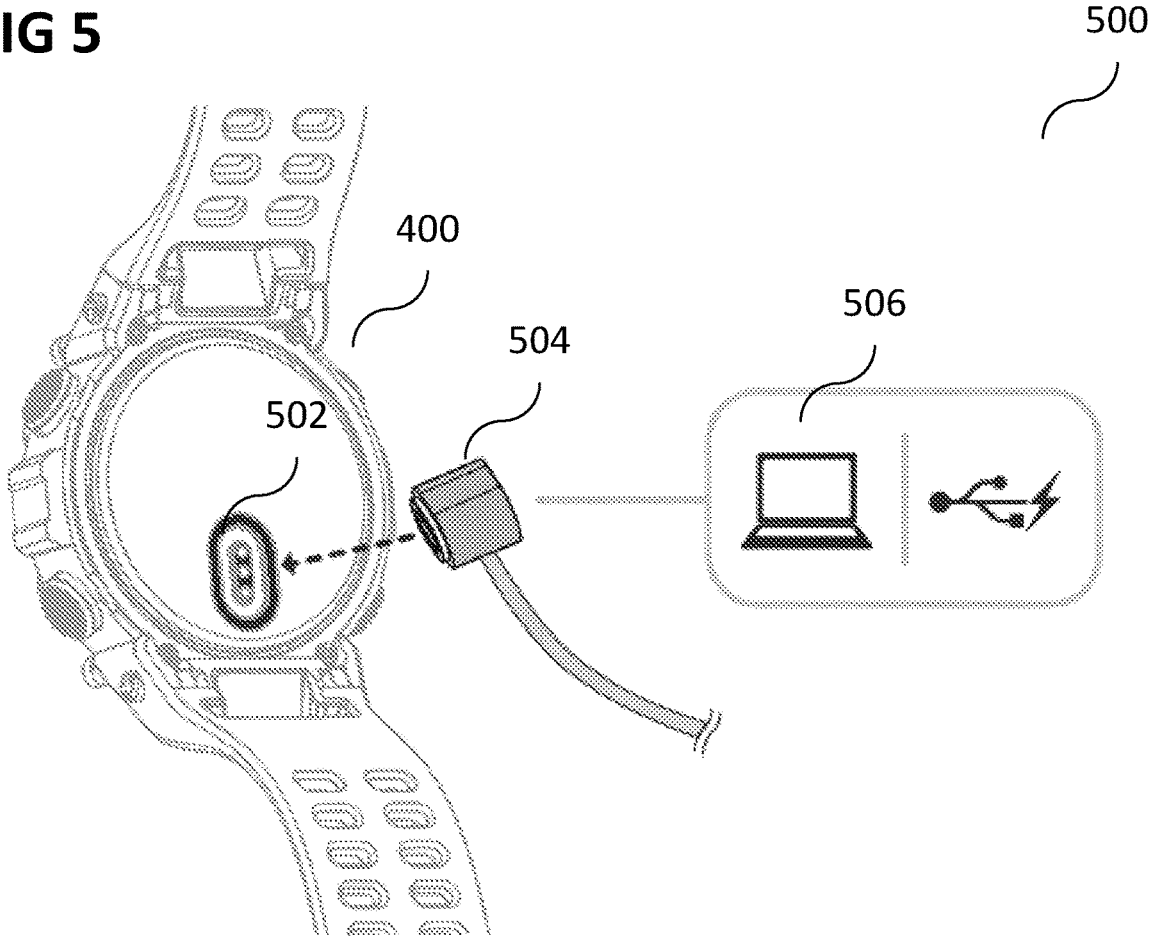
FIG. 5 shows an illustration of charging the watch according to various embodiments.
FIG. 6 shows a table indicating status indicators of a watch according to various embodiments.

FIG. 5 shows an illustration 500 of charging the watch according to various embodiments. A charging port 502 may be provided at the back of the watch. A charging cable 504 may provide a connection from the watch to a PC (personal computer) or a USB (universal serial bus) charger, like indicated by 506. The watch may be removed from the user's wrist before charging it. The approximate time to fully charge the watch may be 2 hours or less.

FIG. 6 shows a table 600 indicating status indicators of a watch according to various embodiments. The first column 602 of the table indicates the symbol shown in the watch (in other words: the indicator), the second column 604 the name of the status indication (in other words: the function), and the third column 606 indicates the description of the status indication. According to various embodiments, the watch may contain indicators that are located on the watch face.

According to various embodiments, the watch may be set manually.

FIG. 7 shows an enlarged view 700 of the watch face and buttons of a watch according to various embodiments.

FIG. 8 shows a table 800 illustrating various symbols according to various embodiments. According to various embodiments, the watch may contain modes that are represented by different symbols. In a first column 802 of the table 800, the symbols are listed. In a second column 804 of table 600, their name (or function) is indicated. In a third column 806 of table 600, their description is given. To select a specific mode, the mode button may be pressed. To change the configuration, the adjust button may be pressed.

According to various embodiments, a user may sign up now for an account (for example a Razer ID account) to get real-time information on the user's product's warranty status (for example the warranty status of the watch according to various embodiments). The user may register his product online, and may be able to view his warranty status if he registered (for example via a website).

The watch according to various embodiments may be referred to as Nabu Watch.

The following examples pertain to further embodiments.

Example 1 is a watch comprising: a timing circuit configured to provide information about a current time; a smart watch circuit configured to provide smart watch functionality; a first battery configured to provide energy to the timing circuit; a second battery configured to provide energy to the smart watch circuit; and a communication circuit configured to provide communication between the timing circuit and the smart watch circuit; and wherein the communication circuit comprises a safety circuit configured to prevent leakage of current from the first battery to the second battery.

In example 2, the subject-matter of example 1 can optionally include that the first battery is configured to provide energy only to the timing circuit.

In example 3, the subject-matter of any one of examples 1 to 2 can optionally include that the first battery is configured to prevent providing energy to the smart watch circuit.

In example 4, the subject-matter of any one of examples 1 to 3 can optionally include that the second battery is configured to provide energy only to the smart watch circuit.

In example 5, the subject-matter of any one of examples 1 to 4 can optionally include that the second battery is configured to provide energy to the smart watch circuit and to the timing circuit if it is determined that the second battery comprises more than a pre-determined energy.

In example 6, the subject-matter of any one of examples 1 to 5 can optionally include that the communication circuit comprises at least one of an input/output buffer or a series of input/output buffers.

In example 7, the subject-matter of example 6 can optionally include that the input/output buffers comprises the safety circuit.

In example 8, the subject-matter of any one of examples 6 to 7 can optionally include that the input/output buffer comprises a plurality of first connections connected to the timing circuit, and comprises a plurality of second connections connected to the smart watch circuit.

In example 9, the subject-matter of example 8 can optionally include that the first connections are configured to float.

In example 10, the subject-matter of any one of examples 8 to 9 can optionally include that the second connections are configured to pull low for output connections among the second connections.

In example 11, the subject-matter of any one of examples 8 to 10 can optionally include that the second connections are configured to use a pullup resistor for input connections among the second connections.

In example 12, the subject-matter of any one of examples 1 to 11 can optionally include that the communication circuit is configured to transmit setting information from the timing circuit to the smart watch circuit.

In example 13, the subject-matter of example 12 can optionally include that the setting information comprises the information about the current time.

In example 14, the subject-matter of any one of examples 12 to 13 can optionally include that the setting information comprises information indicating user preference settings.

In example 15, the subject-matter of any one of examples 1 to 14 can optionally include that the communication circuit is configured to provide synchronization information between the timing circuit and the smart watch circuit.

In example 16, the subject-matter of any one of examples 1 to 15 can optionally include: a display; wherein the timing circuit is configured to provide the information about the current time on the display; wherein the smart watch circuit is configured to provide information based on the smart watch functionality on the display.

In example 17, the subject-matter of any one of examples 1 to 16 can optionally include: a first display; and a second display; and wherein the timing circuit is configured to provide the information about the current time on the first display; and wherein the smart watch circuit is configured to provide information based on the smart watch functionality on the second display.

In example 18, the subject-matter of any one of examples 1 to 17 can optionally include that the first battery comprises a non-rechargeable battery.

In example 19, the subject-matter of any one of examples 1 to 18 can optionally include that the first battery comprises a coin cell.

In example 20, the subject-matter of any one of examples 1 to 19 can optionally include that the first battery is configured to provide a current of at least substantially 20 uA or less.

In example 21, the subject-matter of any one of examples 1 to 20 can optionally include that the second battery comprises a rechargeable battery.

In example 22, the subject-matter of any one of examples 1 to 21 can optionally include that the second battery comprises a lithium ion battery.

In example 23, the subject-matter of any one of examples 1 to 22 can optionally include that the second battery is configured to provide a current of more than 50 uA and on average in a range between 100 uA and 200 uA.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A watch comprising:

a timing circuit comprising input and output connections and configured to provide information about a current time;

a smart watch circuit comprising input and output connections and configured to provide smart watch functionality;

a first battery configured to provide energy to the timing circuit, wherein the first battery is configured to provide energy only to the timing circuit, wherein the timing circuit only provides watch functions selected from the group consisting of time keeping, alarms, timer and lapse;

a second battery configured to provide energy to the smart watch circuit; and a communication circuit configured to provide communication between the timing circuit and the smart watch circuit; and wherein the communication circuit comprises a safety circuit configured to prevent leakage of current from the first battery to the second battery;

wherein the safety circuit, configured to prevent leakage of current from the first battery to the second battery, comprises a first set of input and output connections of the safety circuit which are respectively connected to the input and output connections of the timing circuit, and comprises a second set of input and output connections of the safety circuit which are respectively connected to the input and output connections of the smart watch circuit;

wherein the first set of input and output connections of the safety circuit are configured to float;

wherein the second set of input and output connections of the safety circuit are configured to pull low for respective output connections and are further configured to use a pullup resistor for respective input connections;

wherein the timing circuit is configured to provide a reset signal to the smart watch circuit.

2. The watch of claim 1, wherein the first battery is configured to prevent providing energy to the smart watch circuit.

3. The watch of claim 1, wherein the second battery is configured to provide energy only to the smart watch circuit.

4. The watch of claim 1, wherein the second battery is configured to provide energy to the smart watch circuit and to the timing circuit if it is determined that the second battery comprises more than a pre-determined energy.

5. The watch of claim 1, wherein the communication circuit comprises at least one of an input/output buffer or a series of input/output buffers.

6. The watch of claim 5, wherein the input/output buffers comprises the safety circuit.

7. The watch of claim 1, wherein the communication circuit is configured to transmit setting information from the timing circuit to the smart watch circuit.

8. The watch of claim 7, wherein the setting information comprises at least one of the information about the current time and information indicating user preference settings.

9. The watch of claim 1, wherein the communication circuit is configured to provide synchronization information between the timing circuit and the smart watch circuit.

10. The watch of claim 1, further comprising:

a display;

wherein the timing circuit is configured to provide the information about the current time on the display;

wherein the smart watch circuit is configured to provide information based on the smart watch functionality on the display.

11. The watch of claim 1, further comprising:

a first electronic display; and a second electronic display; and wherein the timing circuit is configured to provide the information about the current time on the first display; and wherein the smart watch circuit is configured to provide information based on the smart watch functionality on the second display.

12. The watch of claim 1, wherein the first battery comprises at least one of a non-rechargeable battery and a coin cell.

13. The watch of claim 1, wherein the first battery is configured to provide a current of at least 20 uA or less.

14. The watch of claim 1, wherein the second battery comprises at least one of a rechargeable battery and a lithium ion battery.

15. The watch of claim 1, wherein the second battery is configured to provide a current of more than 50 uA.

16. The watch of claim 1, further comprising:

a first crystal oscillator connected to the timing circuit; and a second crystal oscillator connected to the smart watch circuit;

wherein the smart watch circuit is configured to communicate with an application on an external electronic device;

wherein the second crystal serves as a real time clock and a timer to maintain a wireless link between the smart watch circuit and the external electronic device.

17. The watch of claim 16, wherein the each of the first crystal oscillator and the second crystal oscillator comprises a 32.768 kHz crystal oscillator.

18. The watch of claim 16, further comprising:

a third crystal oscillator connected to the smart watch circuit for data transfer between the smart watch circuit and the external electronic device.

* * * * *